United States Patent [19]

Schauwecker et al.

[11] Patent Number: 4,590,542

[45] Date of Patent: May 20, 1986

[54] HEADLIGHT FOR MOTOR VEHICLE

[75] Inventors: Frieder Schauwecker, Pfullingen; Walter Weber, Weil der Stadt, both of Fed. Rep. of Germany

[73] Assignee: Robert Bosch GmbH, Stuttgart, Fed. Rep. of Germany

[21] Appl. No.: 713,262

[22] Filed: Mar. 18, 1985

[30] Foreign Application Priority Data

Jul. 10, 1984 [DE] Fed. Rep. of Germany ..... 3425291

[51] Int. Cl.[4] ..... H01R 33/46; F21M 3/00

[52] U.S. Cl. ..... 362/61; 362/226; 362/267

[58] Field of Search ..... 362/61, 80, 82, 83, 362/226, 267, 378, 433, 434, 435, 437, 443

[56] References Cited

U.S. PATENT DOCUMENTS

| | | | |
|---|---|---|---|
| 3,818,215 | 6/1974 | Schmidt et al. | 362/226 |
| 4,100,448 | 7/1978 | Chipner et al. | 362/267 |
| 4,500,946 | 2/1985 | Mikola | 362/226 |
| 4,523,262 | 6/1985 | Shinkai | 362/61 |
| 4,528,619 | 7/1985 | Dolan et al. | 362/61 |

FOREIGN PATENT DOCUMENTS

| | | | |
|---|---|---|---|
| 2732404 | 1/1978 | Fed. Rep. of Germany | 362/267 |

*Primary Examiner*—Craig R. Feinberg
*Assistant Examiner*—David A. Okonsky
*Attorney, Agent, or Firm*—Michael J. Striker

[57] ABSTRACT

A headlight for a motor vehicle includes a bulb holder carrying a bulb, and a reflector of thermosetting plastics, which is releasably connectable to the bulb holder by a bayonet-type lock. A clamping ring mounted on the bulb holder effects a bayonet-type connection between the bulb and the bulb holder.

15 Claims, 1 Drawing Figure

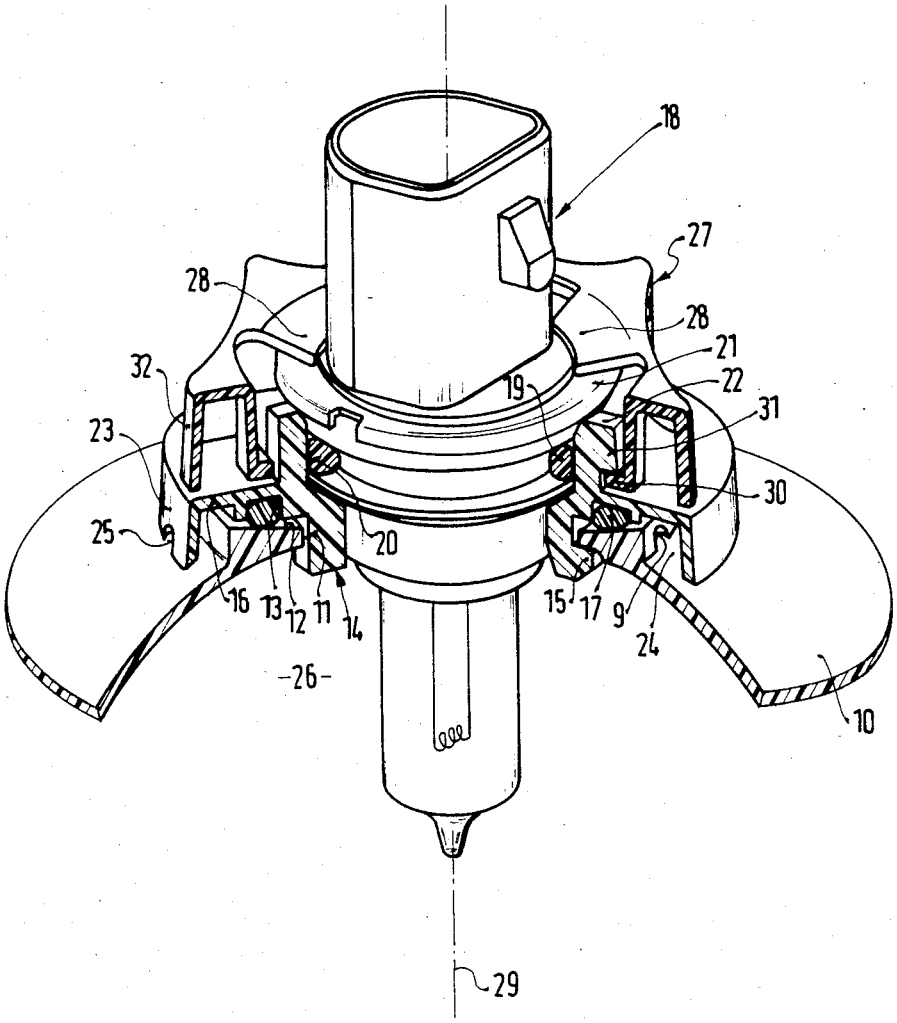
18
27
28
28
21
22
32
19
31
23
30
25
20
16
13
12
11
14
15
17
9
24
-26-
10
29

HEADLIGHT FOR MOTOR VEHICLE

BACKGROUND OF THE INVENTION

The present invention relates to a projecting lamp or headlight for a vehicle, particularly motor vehicle.

Headlights of the type under discussion include a bulb held in a bulb holder, and a reflector. Reflectors of headlights of motor vehicles (dim lights or bright lights) have been normally made of thermosetting plastics due to their high stability and specifically thermal loading capacity; however, the disadvantages of such headlights have been their brittleness and limited possibilities of design because a required mold slope angle has been at least 3°. Further difficulties have occurred in the utilization of pressing molds with slides, in which multi-shaped openings for receiving bulbs have been required. An unobjectionable treatment of thermosetting plastics has been obtained only when a pressing mold enables a favorable flowability of the thermosetting plastic material. The above problem, particularly in manufacturing of bulb-receiving regions of the reflectors makes it difficult to utilize thermoplastic plastics for manufacturing reflectors of the headlights of motor vehicles.

SUMMARY OF THE INVENTION

It is an object of the present invention to provide an improved headlight for motor vehicles.

It is another object of this invention to provide a headlight for motor vehicles which is easier to manufacture as compared to conventional headlights of the foregoing type.

It is yet another object of the invention to provide a headlight with a reflector formed of thermosetting plastics but having a multi-shaped bulb-receiving region which is easy to produce.

These and other objects of the invention are attained by a headlight for a vehicle, particularly a motor vehicle, comprising a reflector made of thermosetting plastics and having an apex opening; a bulb having an axis and including a socket disc; a clamping ring for clamping said bulb in said reflector; a bulb holder of non-thermosetting material and receiving said bulb, said bulb holder being received in said opening, first bayonet lock means acting in a direction of said axis for connecting said bulb holder to said reflector; and second bayonet lock means acting in the direction of said axis for connecting said clamping ring to said bulb holder under interposition of said socket disc of the bulb.

The bulb holder may be made of soft metal by press molding. The soft metal may be aluminum or zinc.

The bulb holder may be also made of heat-resistant thermoplastic synthetic material. This easily treatable material is suggested herein for bulb holders.

To provide for a required sealing of the bulb-receiving holder on the backside of the reflector the latter may be formed in the region of said opening with a conical projection, said bulb holder having an outer flange formed with an annular groove and having an O-ring, said first bayonet lock means operating so that said outer flange presses said O-ring into said annular groove.

To provide for a forcible ventilation in the bulb holder by very simple means said outer flange may have a circumferential collar which projects to said reflector to form therewith a ring-shaped passage, said collar having an outer perforation which opens into atmosphere, said conical projection having an inner perforation, said reflector having an interior, said inner perforation connecting said ring-shaped passage with said interior.

The clamping ring may include at least three tongues which are elastic in the direction of said axis and act to secure said bulb in said bulb holder.

The clamping ring may further include a plurality of gripping strip-like formations projecting to said bulb holder and circumferentially spaced from each other.

The diameter of said collar may be approximately equal to the diameter, at which said formations are arranged.

To ensure the sealing of the bulb relative to the bulb holder the bulb holder may be further formed with an axial annular shoulder, said shoulder pressing a sealing ring against the socket of the bulb.

The sealing ring may be an O-ring.

The bulb holder may include at least three hooks which cooperate with said conical projection of the reflector to form said first bayonet lock means.

The clamping ring may include an inward radial projection and the bulb holder may include at least three hooks which cooperate with said inward radial projection to form said second bayonet lock means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

The single FIGURE of the drawings illustrates a perspective view, partially in section, of a headlight of the invention.

DETAILED DESCRIPTION OF THE PREFERRED EMBODIMENT

Referring now to the drawings in detail, it will be seen that a headlight for a motor vehicle includes a reflector 10 of thermosetting plastics, the non-illustrated lamp outlet opening of which closes a lamp disc. Reflector 10 has an apex opening 11, defined by the edge region of the reflector, which edge region is formed by a ring-shaped cone 12. A bulb holder 14 is an element of thermoplastic plastics made by a non-cutting molding. The bulb holder 14 has three hooks 15, by means of which bulb holder 14 is releasably connected, in the manner of an axially acting bayonet lock, to the edge conical region 12 of reflector 10 in the area of the opening 11. An axial, outwardly projecting flange 16 of bulb holder 14 has an annular groove 13 which receives an O-ring 17 operating as a sealing element. A bulb 18 has at its socket an O-ring 19 which seals and supports the bulb against an axial inner annular shoulder 20 provided on the bulb holder 14. A socket disc 21 of bulb 18 is supported in the axial direction against a radial shoulder 22 of bulb holder 14.

A circumferential overhung collar 23, which extends toward the reflector 10, is provided on the outer flange 16. Collar 23 forms with reflector 10 an annular passage 24 and has an outer through perforation 25 which opens into the atmosphere. An inner perforation 9 is formed in the ring-shaped cone 12 diagonally opposite to perforation 25 so that a continually hermetical connection between the atmosphere and inner space 26 of reflector 10 is provided.

A clamping ring 27, made of plastics and mounted on the bulb holder 14, has three inwardly radially extending tongues 28 which in the direction of axis 29 of bulb 18 or reflector 10 are resilient or spring-elastic and thereby they press the radial disc or flange 21 of bulb 18 against the radial shoulder 22 of bulb holder 14. An inner radial projection 30 of the clamping ring 27 cooperates, in the manner of an axially operating bayonet lock, with three hooks 31 provided on the bulb holder 14. The clamping ring 27 has four gripping strips or moldings 32 which face toward the bulb holder 14 whereby the diameter of collar 23 and the diameter, on which gripping strips 32 are arranged, are approximately the same.

Bulb holder 14 can be also formed as a die cast element of soft metal such as aluminum or zinc.

It will be understood that each of the elements described above, or two or more together, may also find a useful application in other types of headlights for motor vehicles differing from the types described above.

While the invention has been illustrated and described as embodied in a headlight for motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlight for a vehicle, particularly a motor vehicle, comprising a reflector made of thermosetting plastics and having an apex opening; a bulb having an axis and including a socket disc; a clamping ring for clamping of said bulb in said reflector; a bulb holder of non-thermosetting material and receiving said bulb, said bulb holder being received in said opening, first bayonet lock means having opposed planar surfaces coacting along a plane substantially perpendicular to said axis for connecting said bulb holder to said reflector; and second bayonet lock means having opposed planar surfaces coacting along a plane substantially perpendicular to said axis for connecting said clamping ring to said bulb holder, said socket disc of the bulb being interposed between and in direct contact with said clamping ring and said bulb holder.

2. The headlight as defined in claim 1, wherein said bulb holder is made of heat-resistant thermoplastic synthetic material.

3. The headlight as defined in claim 1, wherein said bulb holder is made of soft metal by press molding.

4. The headlight as defined in claim 3, wherein said bulb holder is made of aluminum.

5. The headlight as defined in claim 3, wherein said bulb holder is made of zinc.

6. The headlight as defined in claim 1, wherein said reflector is formed in the region of said opening with a conical projection, said bulb holder having an outer flange formed with an annular groove and having an O-ring, said first bayonet lock means operating so that said outer flange presses said O-ring into said annular groove.

7. The headlight as defined in claim 6, said bulb holder including at least three hooks which cooperate with said conical projection of the reflector to form said first bayonet lock means.

8. The headlight as defined in claim 7, wherein said clamping ring includes an inward radial projection and said bulb holder includes at least three hooks which cooperate with said inward radial projection to form said second bayonet lock means.

9. The headlight as defined in claim 6, wherein said outer flange has a circumferential collar which projects to said reflector to form therewith a ring-shaped passage.

10. The headlight as defined in claim 9, said collar having an outer perforation which opens into atmosphere, said conical projection having an inner perforation, said reflector having an interior, said inner perforation connecting said ring-shaped passage with said interior.

11. The headlight as defined in claim 10, wherein said clamping ring includes at least three tongues which are elastic in the direction of said axis and act to secure said bulb in said bulb holder.

12. The headlight as defined in claim 11, said clamping ring further including a plurality of gripping strip-like formations projecting to said bulb holder and circumferentially spaced from each other.

13. The headlight as defined in claim 12, wherein a diameter of said collar is approximately equal to a diameter, at which said formations are arranged.

14. The headlight as defined in claim 11, said lamp having a socket which is provided with a sealing ring, said bulb holder being further formed with an axial annular shoulder, said shoulder pressing said sealing ring against said socket.

15. The headlight as defined in claim 14, wherein said sealing ring is an O-ring.

* * * * *